US006880726B1

(12) United States Patent
Perez

(10) Patent No.: US 6,880,726 B1
(45) Date of Patent: Apr. 19, 2005

(54) TOOTHPASTE DISPENSING APPARATUS

(76) Inventor: Victor G. Perez, 1190 E. Newbugh St., Azusa, CA (US) 91702

( * ) Notice: Subject to any disclaimer, the term of this patent is extended or adjusted under 35 U.S.C. 154(b) by 44 days.

(21) Appl. No.: 10/374,180

(22) Filed: Feb. 25, 2003

(51) Int. Cl.[7] ..... B65D 35/28
(52) U.S. Cl. ..... 222/102; 222/108; 222/156
(58) Field of Search ..... 222/95, 101, 102, 222/108, 156

(56) References Cited

U.S. PATENT DOCUMENTS 4,403,714 A 9/1983 Kane
5,199,610 A 4/1993 Gagliardi
5,435,465 A * 7/1995 El-Amin ..... 222/108
5,441,172 A * 8/1995 Yu ..... 222/52
5,845,813 A 12/1998 Werner
5,901,886 A * 5/1999 Grindstaff et al. ..... 222/557
5,975,362 A * 11/1999 West ..... 222/102
6,662,971 B1 * 12/2003 Nguyen et al. ..... 222/101
2001/0050290 A1 * 12/2001 Sampson et al. ..... 222/102

* cited by examiner

*Primary Examiner*—Joseph A. Kaufman

(57) ABSTRACT

A toothpaste dispensing apparatus for dispensing toothpaste from a tube. The toothpaste dispensing apparatus includes a housing comprising a perimeter wall. The perimeter wall defines an interior space of the housing. The housing is designed for engaging a support surface whereby the support surface supports the housing. A dispensing assembly extends through the perimeter wall of the housing from the interior space of the housing. The dispensing assembly is designed for engaging the tube whereby the dispensing assembly squeezes toothpaste from the tube onto the toothbrush when the dispensing assembly is actuated by a user.

10 Claims, 5 Drawing Sheets

TOOTHPASTE DISPENSING APPARATUS

BACKGROUND OF THE INVENTION

1. Field of the Invention

The present invention relates to toothpaste dispensers and more particularly pertains to a new toothpaste dispensing apparatus for dispensing toothpaste from a tube.

2. Description of the Prior Art

The use of toothpaste dispensers is known in the prior art. U.S. Pat. No. 4,403,714 describes a device for dispensing toothpaste from a tube and onto a toothbrush. Another type of toothpaste dispenser is U.S. Pat. No. 5,199,610 having a motorized device for receiving a tube of toothpaste and dispensing toothpaste from the tube. U.S. Pat. No. 5,845,813 has a toothpaste dispenser that is motorized and dispenses toothpaste from a tube of toothpaste.

While these devices fulfill their respective, particular objectives and requirements, the need remains for a device that has certain improved features position the toothbrush under the tube of toothpaste to dispense the toothpaste onto the toothbrush.

SUMMARY OF THE INVENTION

The present invention meets the needs presented above by providing a pair of tab members being coupled to the switch member so that the toothbrush is positioned between the tab members when the switch member is actuated and positions the head of the toothbrush under the tube.

Still yet another object of the present invention is to provide a new toothpaste dispensing apparatus that allows the user to use a single hand to apply toothpaste to a toothbrush.

Even still another object of the present invention is to provide a new toothpaste dispensing apparatus that allows for easy clean up of toothpaste dripping from the tube.

To this end, the present invention generally comprises a housing comprising a perimeter wall. The perimeter wall defines an interior space of the housing. The housing is designed for engaging a support surface whereby the support surface supports the housing. A dispensing assembly extends through the perimeter wall of the housing from the interior space of the housing. The dispensing assembly is designed for engaging the tube whereby the dispensing assembly squeezes toothpaste from the tube onto the toothbrush when the dispensing assembly is actuated by a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
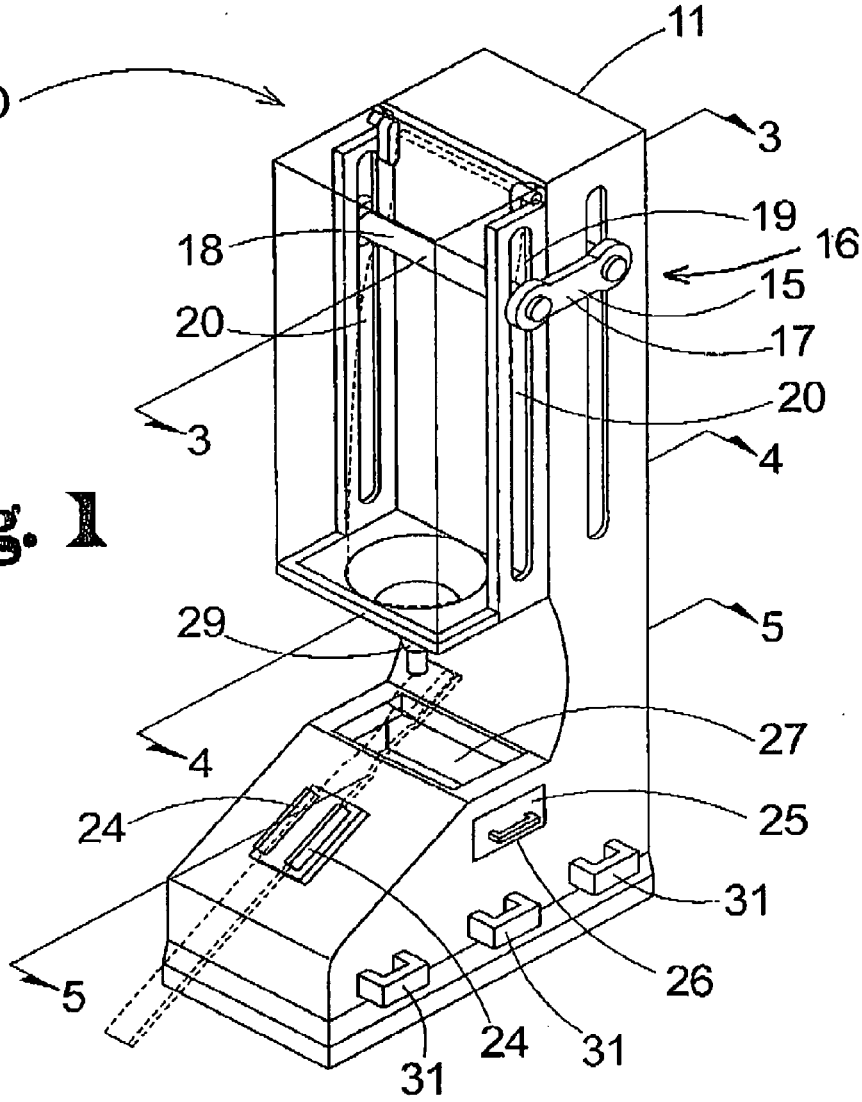
FIG. 1 is a perspective view of a new toothpaste dispensing apparatus according to the present invention.
Figure 2:
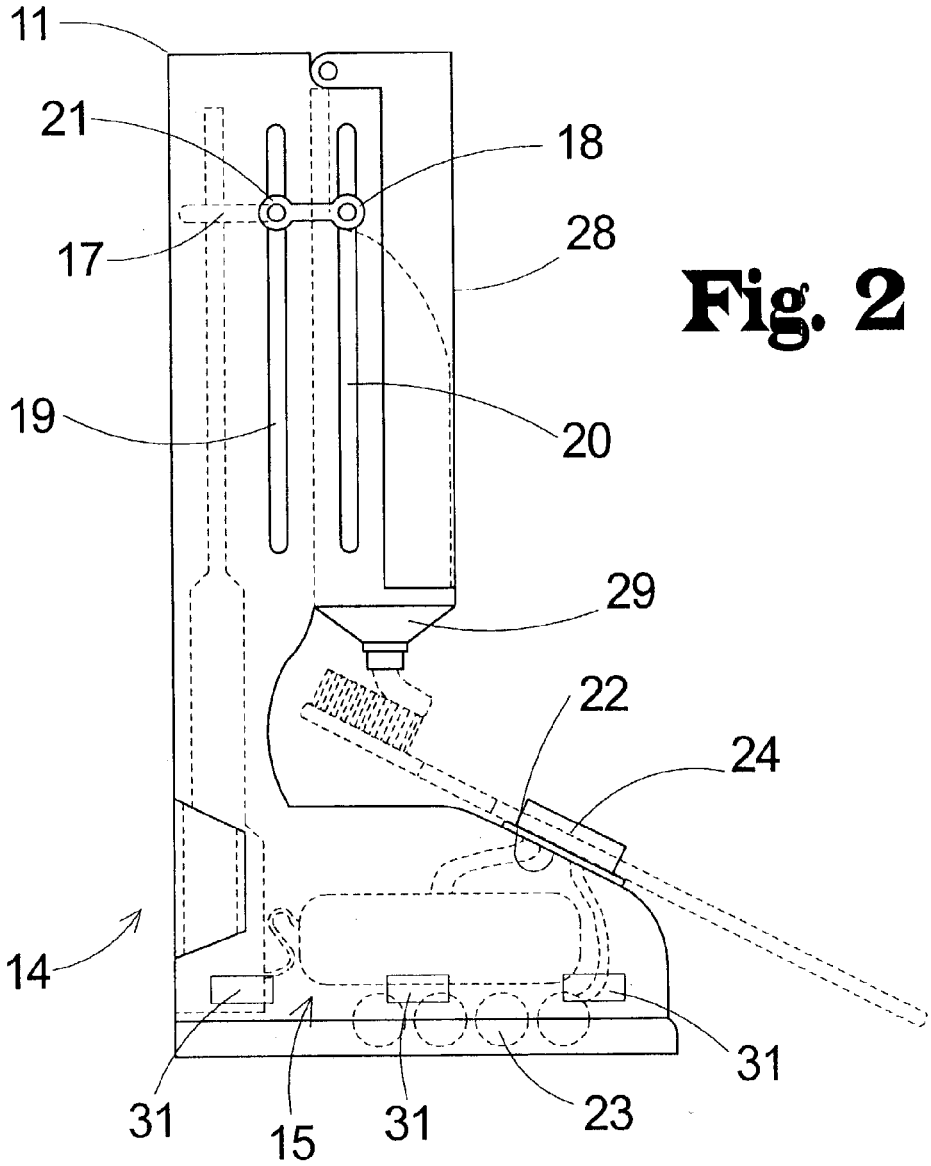
FIG. 2 is a side view of the present invention.
Figure 3:
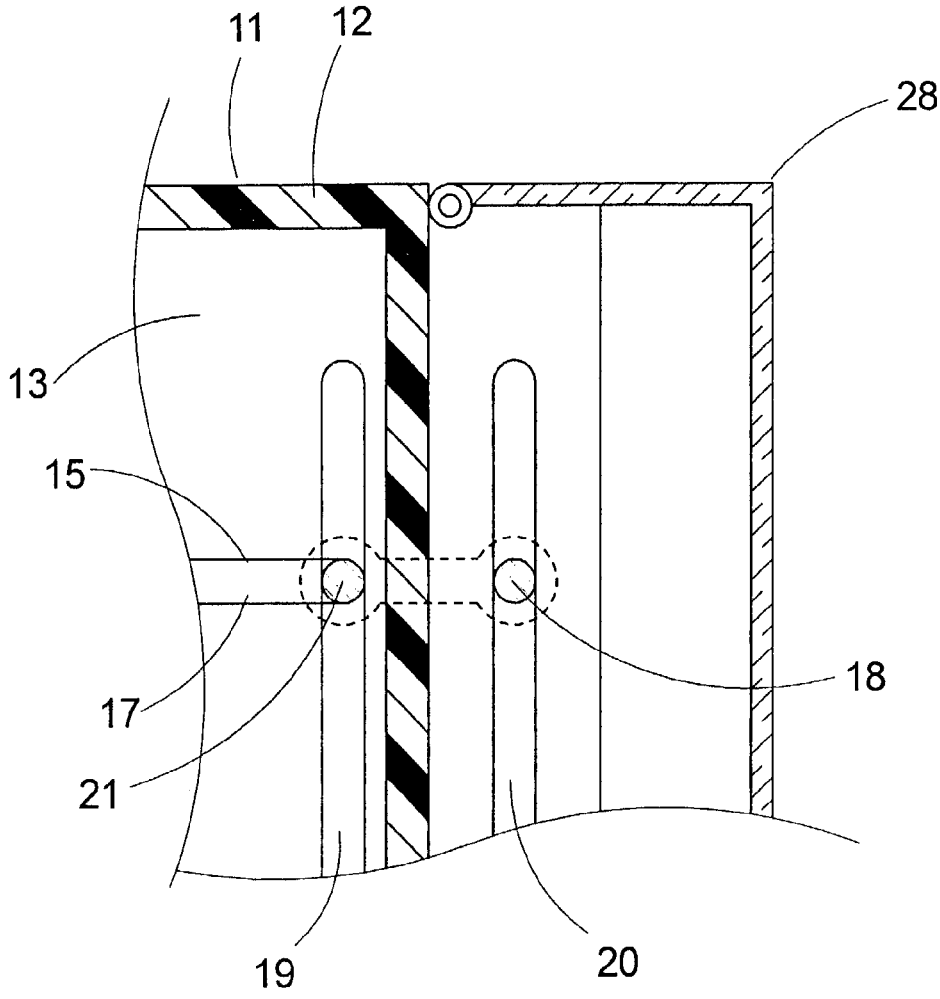
FIG. 3 is a cross-sectional view of the present invention taken alone line 3—3 of FIG. 1.
Figure 4:
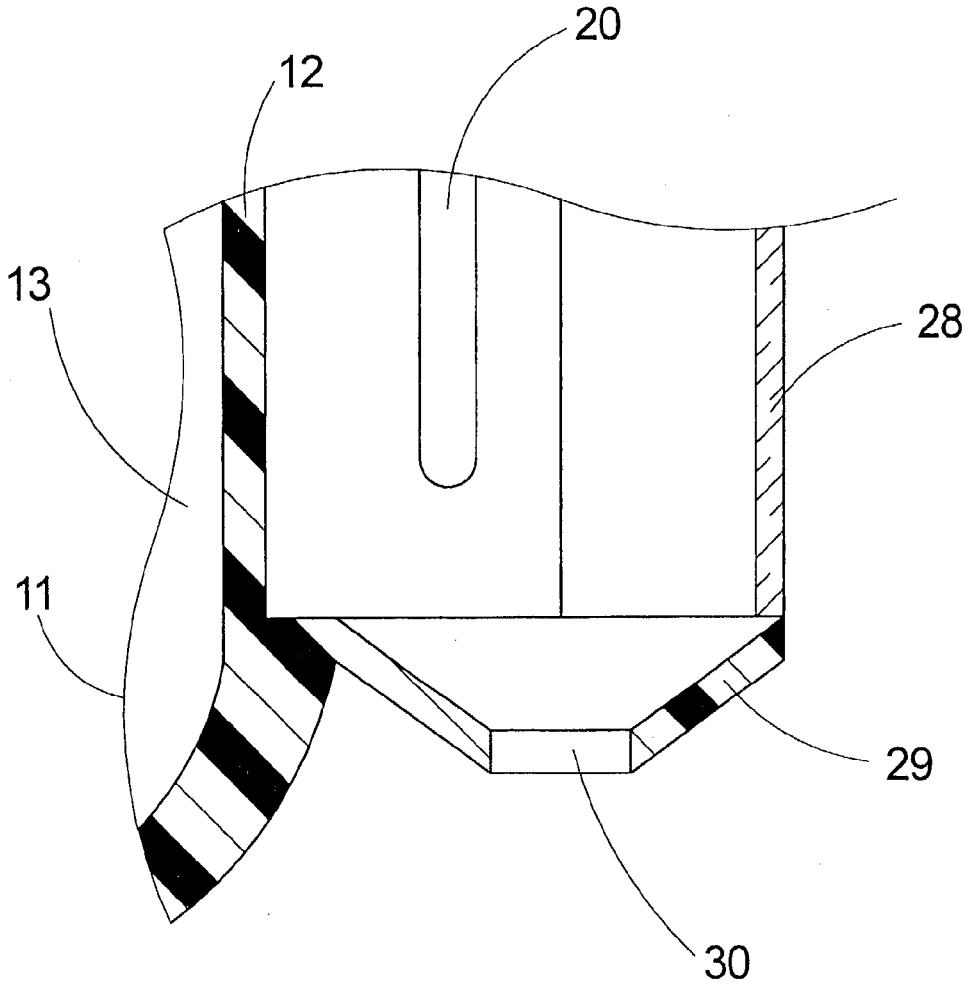
FIG. 4 is a cross-sectional view of the present invention taken alone line 4—4 of FIG. 1.
Figure 5:
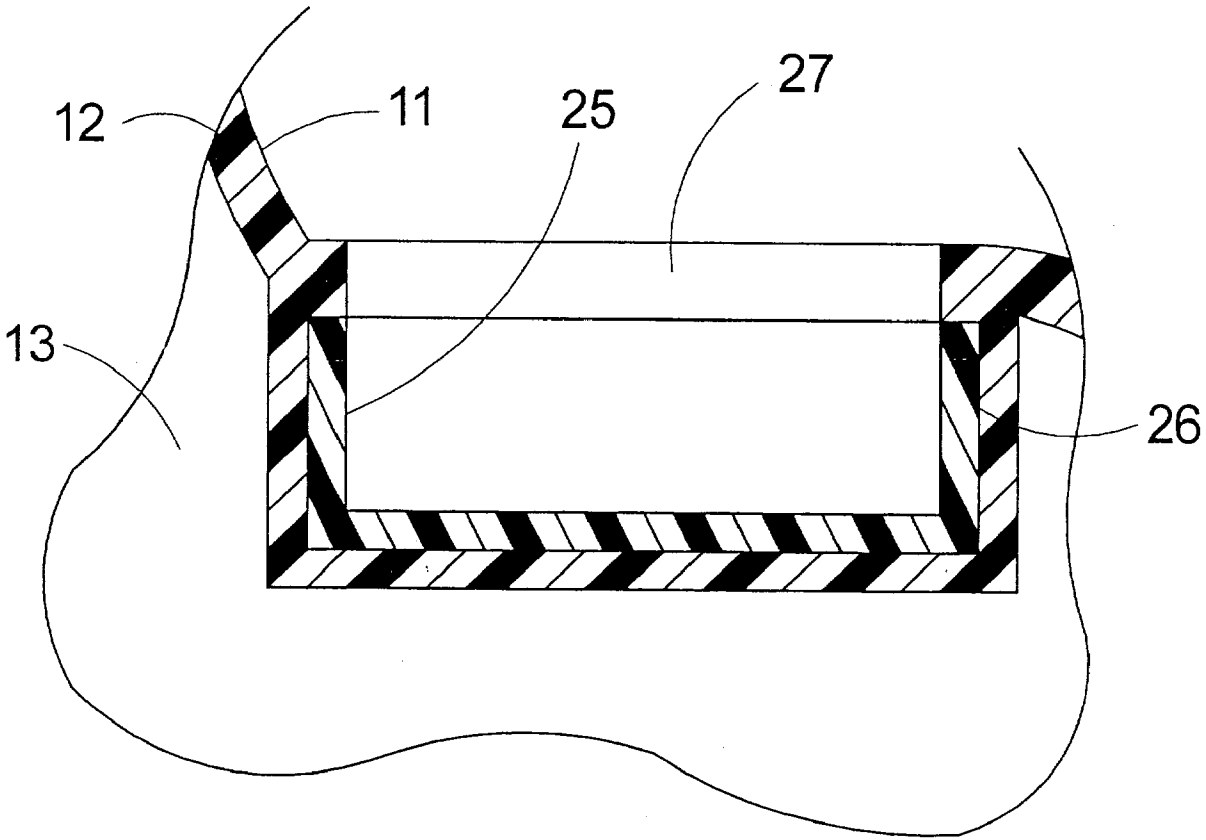
FIG. 5 is a cross-sectional view of the present invention taken alone line 5—5 of FIG. 1.

With reference now to the drawings, and in particular to FIGS. 1 through 5 thereof, a new toothpaste dispensing apparatus embodying the principles and concepts of the present invention and generally designated by the reference numeral 10 will be described.

As best illustrated in FIGS. 1 through 5, the toothpaste dispensing apparatus 10 generally comprises a housing 11 comprising a perimeter wall 12. The perimeter wall 12 defines an interior space 13 of the housing 11. The housing 11 is designed for engaging a support surface whereby the support surface supports the housing 11.

A dispensing assembly 14 extends through the perimeter wall 12 of the housing 11 from the interior space 13 of the housing 11. The dispensing assembly 14 is designed for engaging the tube whereby the dispensing assembly 14 squeezes toothpaste from the tube onto the toothbrush when the dispensing assembly 14 is actuated by a user.

The dispensing assembly 14 comprises an engaging member 15 and an actuating assembly 16. The actuating assembly 16 is positioned in the interior space 13 of the housing 11. The engaging member 15 is operationally coupled to the actuating assembly 16 whereby the actuating assembly 16 actuates the engaging member 15. The engaging member 15 is designed for engaging the tube whereby the engaging member 15 squeezes the toothpaste from the tube when the actuating assembly 16 actuates the engaging member 15. The actuating assembly 16 may comprise an electric motor operationally coupled to a hydraulic actuator or other form of linear actuator to actuate the engaging member 15.

The engaging member 15 comprises a pair of arm portions 17 and a roller portion 18. Each of the arm portions 17 is operationally couple to the actuating assembly 16. Each of the arm portions 17 extends through alignment slots 19 extending through the perimeter wall 12 of the housing 11 whereby each of the arm portions 17 extend out of the housing 11. The roller portion 18 is rotatably coupled between the arm portions 17 whereby the roller portion 18 is positioned opposite the actuating assembly 16. The roller portion 18 is designed for selectively engaging the tube whereby the roller portion 18 of the engaging member 15 compresses the tube between the roller portion 18 and the perimeter wall 12 of the housing 11 to squeeze the toothpaste from the tube when the engaging member 15 is actuated by the actuating assembly 16.

The perimeter wall 12 of the housing 11 comprises a pair of roller slots 20. Each of the roller slots 20 extends through the perimeter wall 12 of the housing 11 whereby each of the roller slots are positioned substantially parallel to an associated one of the alignment slots 19. The roller portion 18 of the engaging member 15 extends through the roller slots 20 of the housing 11 whereby the roller slots 20 are for maintaining alignment of the roller with the perimeter wall 12 of the housing 11 when the engaging member 15 is actuated by the actuating member.

The engaging member 15 comprises a support roller 21. The support roller 21 is rotatably coupled between the arm portions 17 of the engaging member 15 whereby the support roller 21 is positioned between the roller portion 18 and the actuating assembly 16. The support roller 21 rolls on the perimeter wall 12 opposite the roller portion 18 whereby the support roller 21 is for maintaining a distance between the roller portion 18 and the perimeter wall 12 of the housing 11 when the tube is positioned between the perimeter wall 12 and the roller portion 18 of the engaging member 15.

The dispensing assembly 14 comprises a switch member 22. The switch member 22 is operationally coupled between a power source 23 and the actuating assembly 16. The switch member 22 is coupled to the perimeter wall 12 of the housing 11 whereby the switch member 22 is designed for being accessed by the user. The switch member 22 controls power being supplied from the power source 23 to the actuating assembly 16 when the switch member 22 is actuated by the user.

A pair of tab members 24 are coupled to the switch member 22 whereby the tab members 24 outwardly extend from the perimeter wall 12 of the housing 11. The tab members 24 are positioned in a spaced relationship whereby the tab members 24 are designed for selectively receiving the toothbrush between the tab members 24 for positioning the head of the toothbrush under the tube when the toothpaste is dispensed from the tube.

A receiving drawer 25 is selectively slid into a drawer aperture 26 extending into the perimeter wall 12 of the housing 11. The receiving drawer 25 is aligned with a drip aperture 27 extending through the perimeter wall 12 of the housing 11. The drip aperture 27 is designed for being positioned below the tube whereby the receiving drawer 25 receives dripping toothpaste dripping from the tube and through the drip aperture 27. The receiving drawer 25 is selectively removable from the housing 11 for disposing of the toothpaste dripped from the tube.

A cover member 28 is hingably coupled to the housing 11. The cover member 28 is designed for selectively covering the tube when the tube is being engaged by the dispensing assembly 14. The cover member 28 comprises a transparent material. The transparent material is designed for letting the user see the tube to determine the amount of toothpaste left in the tube when the cover member 28 is covering the tube. The housing 11 comprises a spout portion 29. The spout portion 29 extends from the perimeter wall 12 whereby a tube aperture 30 extends through the perimeter wall 12 and the spout portion 29. The spout portion 29 is designed for engaging the tube to support the tube when the tube is being engage by the dispensing assembly 14 whereby an end of tube extends from the tube aperture 30 of the housing 111 for dispensing the toothpaste being squeezed from the tube.

A plurality of toothbrush support members 31 are coupled to the housing 11. Each of the toothbrush support members 31 is designed for supporting a toothbrush between the associated one of the toothbrush support members 31 and the housing 11 when the user is not using the toothbrush.

In use, the user places the tube so that the tube is supported in the spout portion 29 of the housing 11 and is positioned under the roller portion 18 of the engaging member 15. The cover member 28 is then closed over the tube. The toothbrush is then positioned between the tab members 24 and pushed down to actuate the switch member 22 and the toothbrush is slid between the tab members 24 to ensure that the toothpaste is placed along the length of the head of the toothbrush. The user then removes the toothbrush from between the tab members 24 and the user brushes their teeth. The receiving drawer 25 can be removed from the housing 11 to dispose of toothpaste that has dripped from the tube.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toothpaste dispensing apparatus for dispensing toothpaste from a tube onto a toothbrush, the toothpaste dispensing apparatus comprising:

a housing comprising a perimeter wall, said perimeter wall defining an interior space of said housing, said housing being adapted for engaging a support surface such that the support surface supports said housing;

a dispensing assembly extending through said perimeter wall of said housing from said interior space of said housing, said dispensing assembly being adapted for engaging the tube such that said dispensing assembly squeezes toothpaste from the tube onto the toothbrush when said dispensing assembly is actuated by a user;

said dispensing assembly comprising an engaging member and an actuating assembly, said actuating assembly being positioned in said interior space of said housing, said engaging member being operationally coupled to said actuating assembly such that said actuating assembly actuates said engaging member, said engaging member being adapted for engaging the tube such that said engaging member squeezes the toothpaste from the tube when said actuating assembly actuates said engaging member;

said engaging member comprising a pair of arm portions and a roller portion, each of said arm portions being operationally coupled to said actuating assembly, each of said arm portions extending through alignment slots extending through said perimeter wall of said housing such that each of said arm portions extend out of said housing, said roller portion being rotatably coupled between said arm portions such that said roller portion is positioned opposite said actuating assembly, said roller portion being adapted for selectively engaging the tube such that said roller portion of said engaging member compresses the tube between said roller portion and said perimeter wall of said housing to squeeze the toothpaste from the tube when said engaging member is actuated by said actuating assembly; and said engaging member comprising a support roller, said support roller being rotatably coupled between said arm portions of said engaging member such that said support roller is positioned between said roller portion and said actuating assembly, said support roller being positioned substantially parallel to said roller portion, said support roller rolling on said perimeter wall opposite said roller portion such that said support roller is for maintaining a distance between said roller portion and said perimeter wall of said housing when the tube is positioned between said perimeter wall and said roller portion of said engaging member.

2. The toothpaste dispensing apparatus as set forth in claim 1, further comprising:

said perimeter wall of said housing comprising a pair of roller slots, each of said roller slots extending through said perimeter wall of said housing such that each of said roller slots are positioned substantially parallel to an associated one of said alignment slots, said roller portion of said engaging member extending through said roller slots of said housing such that said roller slots are for maintaining alignment of said roller with said perimeter wall of said housing when said engaging member is actuated by the actuating member.

3. The toothpaste dispensing apparatus as set forth in claim 1, further comprising:

said dispensing assembly comprising a switch member, said switch member being operationally coupled between a power source and said actuating assembly, said switch member being coupled to said perimeter wall of said housing such that said switch member is adapted for being accessed by the user, said switch member controlling power being supplied from said power source to said actuating assembly when said switch member is actuated by the user.

4. The toothpaste dispensing apparatus as set forth in claim 3, further comprising:

a pair of tab members being coupled to said switch member such that said tab members outwardly extend from said perimeter wall of said housing, said tab members being positioned in a spaced relationship such that said tab members are adapted for selectively receiving the toothbrush between said tab members for positioning the head of the toothbrush under the tube when the toothpaste is dispensed from the tube.

5. The toothpaste dispensing apparatus as set forth in claim 1, further comprising:

a receiving drawer being selectively slid into a drawer aperture extending into said perimeter wall of said housing, said receiving drawer being aligned with a drip aperture extending through said perimeter wall of said housing, said drip aperture being adapted for being positioned below the tube such that said receiving drawer receives dripping toothpaste dripping from the tube and through said drip aperture, said receiving drawer being selectively removable from said housing for disposing of the toothpaste dripped from the tube.

6. The toothpaste dispensing apparatus as set forth in claim 1, further comprising:

a cover member being hingably coupled to said housing, said cover member being adapted for selectively covering the tube when the tube is being engaged by said dispensing assembly.

7. The toothpaste dispensing apparatus as set forth in claim 6, further comprising:

said cover member comprising a transparent material, said transparent material being adapted for letting the user see the tube to determine the amount of toothpaste left in the tube when said cover member is covering the tube.

8. The toothpaste dispensing apparatus as set forth in claim 1, further comprising:

said housing comprising a spout portion, said spout portion extending from said perimeter wall such that a tube aperture extends through said perimeter wall and said spout portion, said spout portion being adapted for engaging the tube to support the tube when the tube is being engage by said dispensing assembly such that an end of tube extends from said tube aperture of said housing for dispensing the toothpaste being squeezed from the tube.

9. The toothpaste dispensing apparatus as set forth in claim 1, further comprising:

a plurality of toothbrush support members being coupled to said housing, each of said toothbrush support members being adapted for supporting a toothbrush between the associated one of said toothbrush support members and said housing when the user is not using the toothbrush.

10. A toothpaste dispensing apparatus for dispensing toothpaste from a tube onto a toothbrush, the toothpaste dispensing apparatus comprising:

a housing comprising a perimeter wall, said perimeter wall defining an interior space of said housing, said housing being adapted for engaging a support surface such that the support surface supports said housing;

a dispensing assembly extending through said perimeter wall of said housing from said interior space of said housing, said dispensing assembly being adapted for engaging the tube such that said dispensing assembly squeezes toothpaste from the tube onto the toothbrush when said dispensing assembly is actuated by a user;

said dispensing assembly comprising an engaging member and an actuating assembly, said actuating assembly being positioned in said interior space of said housing, said engaging member being operationally coupled to said actuating assembly such that said actuating assembly actuates said engaging member, said engaging member being adapted for engaging the tube such that said engaging member squeezes the toothpaste from the tube when said actuating assembly actuates said engaging member;

said engaging member comprising a pair of arm portions and a roller portion, each of said arm portions being operationally coupled to said actuating assembly, each of said arm portions extending through alignment slots extending through said perimeter wall of said housing such that each of said arm portions extend out of said housing, said roller portion being rotatably coupled between said arm portions such that said roller portion is positioned opposite said actuating assembly, said roller portion being adapted for selectively engaging the tube such that said roller portion of said engaging member compresses the tube between said roller portion and said perimeter wall of said housing to squeeze the toothpaste from the tube when said engaging member is actuated by said actuating assembly;

said perimeter wall of said housing comprising a pair of roller slots, each of said roller slots extending through said perimeter wall of said housing such that each of said roller slots are positioned substantially parallel to an associated one of said alignment slots, said roller portion of said engaging member extending through said roller slots of said housing such that said roller slots are for maintaining alignment of said roller with said perimeter wall of said housing when said engaging member is actuated by the actuating member;

said engaging member comprising a support roller, said support roller being rotatably coupled between said arm portions of said engaging member such that said support roller is positioned between said roller portion and said actuating assembly, said support roller being positioned substantially parallel to said roller portion, said support roller rolling on said perimeter wall opposite said roller portion such that said support roller is for maintaining a distance between said roller portion and said perimeter wall of said housing when the tube is positioned between said perimeter wall and said roller portion of said engaging member;

said dispensing assembly comprising a switch member, said switch member being operationally coupled between a power source and said actuating assembly, said switch member being coupled to said perimeter wall of said housing such that said switch member is adapted for being accessed by the user, said switch member controlling power being supplied from said power source to said actuating assembly when said switch member is actuated by the user;

a pair of tab members being coupled to said switch member such that said tab members outwardly extend from said perimeter wall of said housing, said tab members being positioned in a spaced relationship such that said tab members are adapted for selectively receiving the toothbrush between said tab members for positioning the head of the toothbrush under the tube when the toothpaste is dispensed from the tube;

a receiving drawer being selectively slid into a drawer aperture extending into said perimeter wall of said housing, said receiving drawer being aligned with a drip aperture extending through said perimeter wall of said housing, said drip aperture being adapted for being positioned below the tube such that said receiving drawer receives dripping toothpaste dripping from the tube and through said drip aperture, said receiving drawer being selectively removable from said housing for disposing of the toothpaste dripped from the tube;

a cover member being hingably coupled to said housing, said cover member being adapted for selectively covering the tube when the tube is being engaged by said dispensing assembly;

said cover member comprising a transparent material, said transparent material being adapted for letting the user see the tube to determine the amount of toothpaste left in the tube when said cover member is covering the tube; and said housing comprising a spout portion, said spout portion extending from said perimeter wall such that a tube aperture extends through said perimeter wall and said spout portion, said spout portion being adapted for engaging the tube to support the tube when the tube is being engage by said dispensing assembly such that an end of tube extends from said tube aperture of said housing for dispensing the toothpaste being squeezed from the tube.

* * * * *